US008894257B2

(12) United States Patent
Rice et al.

(10) Patent No.: US 8,894,257 B2
(45) Date of Patent: Nov. 25, 2014

(54) HEADLAMP FEATURING BOTH LOW-BEAM AND HIGH-BEAM OUTPUTS AND DEVOID OF MOVING PARTS

(75) Inventors: Lawrence M. Rice, Hillsboro, NH (US); Thomas Tessnow, Weare, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 167 days.

(21) Appl. No.: 13/474,148

(22) Filed: May 17, 2012

(65) Prior Publication Data

US 2013/0308328 A1 Nov. 21, 2013

(51) Int. Cl.
*F21V 7/00* (2006.01)

(52) U.S. Cl.
USPC ..... 362/516; 362/538

(58) Field of Classification Search
CPC . F21S 48/145; F21S 48/1159; F21S 48/1388; F21S 48/335; F21S 48/115; F21S 48/125; B60Q 1/04; F21V 7/00
USPC ..... 362/516–519, 538, 539, 543–548
See application file for complete search history.

(56) References Cited

U.S. PATENT DOCUMENTS

| | | | | |
|---|---|---|---|---|
| 7,134,774 | B2 | 11/2006 | Iwasaki | |
| 7,178,957 | B2 | 2/2007 | Schug et al. | |
| 7,311,430 | B2 * | 12/2007 | Tsukamoto et al. | 362/545 |
| 7,563,008 | B2 | 7/2009 | Chinniah et al. | |
| 7,607,811 | B2 * | 10/2009 | Okada | 362/545 |
| 2004/0202007 | A1 * | 10/2004 | Yagi et al. | 362/545 |
| 2006/0120094 | A1 * | 6/2006 | Tsukamoto et al. | 362/518 |
| 2007/0236953 | A1 * | 10/2007 | Nakazawa et al. | 362/544 |
| 2008/0062709 | A1 * | 3/2008 | Mochizuki et al. | 362/539 |
| 2009/0103323 | A1 * | 4/2009 | Ishida | 362/538 |

* cited by examiner

*Primary Examiner* — Julie Bannan
(74) *Attorney, Agent, or Firm* — Edward S. Podszus

(57) ABSTRACT

A headlight produces low-beam and high-beam outputs without requiring moving parts. Low-beam LED array (7) near first focus (F1) of ellipsoidal reflector (3) directs light laterally against reflector (3) which directs it toward second focus (F2) of reflector. Cut-off edge (4; 5; 63) near second focus forms a bright/dark edge in low-beam output. Cut-off edge is a vertically-oriented light baffle (4) whose top edge forms the bright/dark edge. Cut-off edge is a horizontal light occluding member (16) whose front edge (63) forms bright/dark edge. Cut-off edge is a corner of a heat sink (200). Cut-off edge is located near focal point of lens (2) which transmits low-beam output with a bright/dark edge. Stationary folding mirror (5) near second focus of reflector directs light from high-beam LED array (8) to lens (2). Additive light reflecting from folding mirror (5) transmitting through lens (2) forms high-beam output lacking a bright/dark edge.

19 Claims, 8 Drawing Sheets

HEADLAMP FEATURING BOTH LOW-BEAM AND HIGH-BEAM OUTPUTS AND DEVOID OF MOVING PARTS

TECHNICAL FIELD

The present disclosure relates to a projector-style automobile headlamp emitting both a low-beam output and a high-beam output.

BACKGROUND

Automobiles are equipped with both low-beam and high-beam outputs from their headlights. The low-beam output is usually angled downward and slightly away from oncoming traffic, in order to reduce glare for oncoming vehicles on the opposite side of the road. The high-beam output is brighter and lacks the directional requirements of the low-beam output, and as such is suitable only when alone on the road. Because of the different angular requirements of the low-beam and high-beam outputs, switching between low and high beams is not as straightforward as making the headlamp brighter or dimmer.

For many years, until the mid-1980s, automobiles were typically equipped with separate headlamps for the low-beam and high-beam outputs. The low-beam and high-beam headlamps were mounted adjacent to each other on the front of vehicles, and were aimed appropriately to meet the angular requirements of the low and high beams.

For a variety of reasons, it is desirable to have a single headlamp produce both low-beam and high-beam outputs.

One example of a single headlamp that produces both low-beam and high-beam outputs is known as a projector lamp. Essentially, the typical configuration for the projector headlamp uses a shield or light baffle that is movable by a solenoid or other actuator. For low beams, the shield is in place, deliberately blocking a portion of the lamp output in order to achieve the desired angular output. For high beams, the shield is moved out of the way and uncovers the brightest part of the beam.

One potential drawback of this known configuration of projector lamp is that includes moving parts, which are more prone to failure than comparable stationary parts.

Accordingly, it would be advantageous to have a configuration of projection headlamp that produces both low-beam and high-beam outputs but lacks moving parts.

Other headlamps are known in U.S. Pat. No. 7,563,008 (Chinniah, et al.); U.S. Pat. No. 7,134,774 (Iwasaki) and U.S. Pat. No. 7,178,957 (Schug, et al.).

SUMMARY

An embodiment a headlight producing a low-beam and a high-beam and having a generally horizontal longitudinal axis. The headlight includes a transmissive lens through which light exits the headlight. The headlight also includes a concave reflector that receives low-beam light from a low-beam source and directs reflected low-beam light toward the lens. The headlight also includes a cut-off edge disposed longitudinally adjacent to the lens that comprises an edge that blocks a portion of the reflected low-beam light and forms a bright/dark edge in the reflected low-beam light. The headlight also includes a stationary mirror disposed proximate the edge of the cut-off edge. The mirror receives high-beam light from a high-beam source and directs reflected high-beam light toward the lens. The reflected high-beam light lacks a bright/dark edge.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

In this document, the directional terms "up", "down", "top", "bottom", "side", "lateral", "longitudinal" and the like are used to describe the absolute and relative orientations of particular elements. For these descriptions, it is assumed that light exits through a "front" of the headlight, with a spatial distribution centered around a longitudinal axis that is generally perpendicular to the front of the headlight, and is generally parallel to the ground. These descriptions include the minor angular deviations from orthogonality that account for reducing glare for oncoming vehicles. It will be understood that while such descriptions provide orientations that occur in typical use, other orientations are certainly possible. The noted descriptive terms, as used herein, still apply if the headlight is pointed upward, downward, horizontally, or in any other suitable orientation.

An automobile headlight produces both a low-beam output and a high-beam output, and does so without any moving parts. For the low-beams, a low-beam LED array is placed near the first focus of an ellipsoidal reflector. Light from the low-beam LED array is directed laterally against the reflector, which directs it toward the second focus of the reflector, while the high-beam LED array is not energized. A cut-off element is placed near the second focus, an edge of which forms a bright/dark edge in the low-beam light. In some cases, the element is a vertically-oriented light baffle, the top edge of which forms the bright/dark edge. In other cases, the element is a horizontally-oriented light occluding member, the front edge of which forms the bright/dark edge. The element is located at or near the focal point of a lens, so that the low-beam output is transmitted through the lens with a bright/dark edge in its angular output. For the high-beams, a stationary folding mirror is placed near the second focus of the reflector. The folding mirror directs light from a high-beam LED array to the lens. The light reflecting from the folding mirror and transmitting through the lens forms the high-beam output, which lacks a bright/dark edge.

The above paragraph is merely a generalization of several of the elements and features described in detail below, and should not be construed as limiting in any way.

Figure 1:
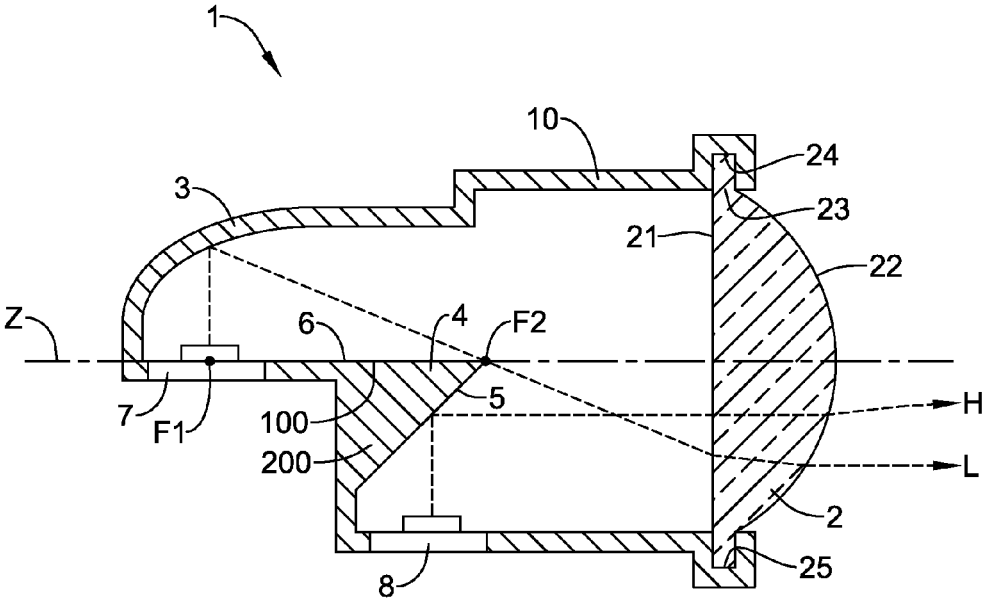
FIG. 1 is a cross-sectional drawing of a configuration of a headlight.

FIG. 1 is a cross-sectional drawing of a headlight 1 that can produce both low-beam and high-beam outputs with no moving parts. The headlight 1 includes a housing 10 that mechanically supports the internal components.

As a first-order approximation, one may think of the headlight 1 having an ellipsoidal reflector with an LED array at one focus of the ellipsoid, an image of the LED array formed at the second focus of the ellipsoid, and a lens having its focal point coincident with the second focus of the ellipsoid. The light baffle is located close to the second focus. Because the light baffle is at or near the focal point of the lens, the bright/dark edge formed by the light baffle becomes a bright/dark edge in the angular output of the low beams. For the high-beam output, a folding mirror is located close to the light baffle and close to the second focus, which directs light from another LED array through the lens. The high beams have no such bright-dark edge. Note that this is merely a first-order approximation. For instance, in order to improve the performance of the angular output, the reflector may deviate from being truly ellipsoidal and may even be non-rotationally symmetric. As another example, the surface profile of the reflector may be adjusted to improve the off-axis performance in imaging the LED array from the first focus to the second focus; note that the real LED array is an extended source, and is not a point source located exactly at the first focus. Keeping these first-order approximations in mind, we describe the components of the headlight 1 in more detail.

The headlight 1 includes a positive lens 2 that transmits both the low-beam and the high-beam outputs. In the configuration of FIG. 1, the side 21 facing the rear of the headlight 1 is planar. A potential advantage for using a plano-convex lens is that because the lens surfaces are typically not coated with anti-reflection coatings, a planar incident surface may reduce or minimize the reflection losses at the surface. A curved incident surface may lead to higher Fresnel reflection losses at higher angles of incidence, found at the edges of the beam. Still, if reflection losses do not pose any difficulty, then the inner side of the lens 2 may be curved, either in a convex or concave manner, so that the lens 2 may be bi-convex, meniscus, or plano-convex.

The lens 2 has a convex side 22 facing outward (i.e., toward the front of the automobile). In most configurations, the convex side 22 is aspheric (i.e., is not purely spherical). Typically, the convex side 22 of the lens includes one or more aspheric terms in its surface prescription, and may optionally include a non-zero conic constant. Optionally, one or both sides of the lens 2 may be rotationally asymmetric, in order improve the output characteristics of the low-beam and/or high-beam outputs.

The lens 2 may be "fluted", where one or both sides of the lens may include one or more narrow ribs along its surface. These "flutes" may partially diffuse the light transmitted through the lens, which in some cases may improve the desired performance of the lens 2. The lens flutes, along with the surface profiles and the other geometry inside the housing 10, are one of several elements that can be varied during the design process to produce the desired output.

The lens 2 may have features that can assist with alignment or mounting. For instance, the outer circumference of the lens 2 may have a flange 23 that extends into a suitably sized groove 24 or notch 25 in the housing 10. One or both sides of the flange 23 may be flat, so that the lens may be aligned against a reference surface on the housing 10 by contacting the flat portion of the flange 23.

The lens 2 itself may be formed from any suitable glass or plastic material. In general, the lens material should be strong enough to endure years of use without fracturing or discoloring. In general, the lens 2 may use any one of a variety of known materials, including any that are used in current generations of headlights. Because the headlights 1 are produced in relatively large quantities, the lenses 2 are typically produced in a known manner by molding.

The lens 2 has a focal point roughly coincident with the second focus F2 of the concave reflector 3.

If the concave reflector 3 were a true ellipsoid, then at it second focus F2 it would form a perfect image of an object placed at its first focus F1. In practice, the imaging is not perfect due to diffraction and due to wavefront aberrations that occur from imaging an extended source (i.e., an LED array that has a finite size) with a nearly ellipsoidal surface. In order to improve the angular characteristics of the low-beam output, the reflector 3 is deviated slightly from a true ellipsoid. This deviation is smallest at the heel of the reflector 3 (i.e., the portion of the reflection that intersects the longitudinal axis Z), and becomes larger farther away from the heel. For the purposes of this document, the reflector 3 is said to be "generally ellipsoidal", where the term "generally" is intended to account for these small deviations from the true ellipsoid. The imaging properties of the two foci still apply for the generally ellipsoidal shape. In other words, low-beam light that originates at the first focus F1 is still imaged onto the second focus F2, and is directed by the concave reflector 3 toward the lens 2.

Note that the concave reflector 3 need not extend fully around the longitudinal axis Z, but may only include the "top" half of the ellipsoid, where the "top" half is farther from the ground than a corresponding "bottom" half would be. Because the reflector 3 is intended to reflect light from a low-beam LED array 7, and the light from the low-beam LED array 7 extends only in the half-space adjacent to the low-beam LED array 7 (as opposed to the full space into which an incandescent bulb radiates), the reflector 3 need only be a half ellipsoid to collect all the light from the LED array 7. In other words, if the "bottom" half of the reflector 3 were present, the bottom half wouldn't receive any light from the low-beam LED array 7.

Note that the low-beam LED array 7 may be a generally rectangular or square array of LEDs. The LEDs in a typical array are square or rectangular, with thin "dead" spaces of non-emission between the individual LEDs. The array 7 may have a square configuration, such as 2 by 2, 3 by 3, 4 by 4, and so forth. The array 7 may alternatively have a rectangular configuration, such as 1 by 2, 1 by 3, 1 by 4, 2 by 3, 2 by 4, 3 by 4, and so forth. As a further alternative, the array may have an irregular shape, such a "plus" sign, a "T" shape, a generally circular or elongated footprint, and so forth. The LEDs in the array 7 may emit with a generally white light, and may be formed with a phosphorescent coating applied over a blue or violet emitter. In general, the structure and function of the low-beam LED array 7 is known.

The low-beam LED array 7 in the headlight 1 is arranged to project generally "upward", away from the ground and perpendicular to the longitudinal axis Z. The light distribution from the LED array may be said to be centered around a vertical axis.

The concave reflector 3 images the low-beam LED array 7 from the first focus F1 onto the second focus F2. A light baffle 4 is superimposed onto the image of the LED array 7 at the second focus F2, which forms a bright/dark edge in the LED light. This bright/dark edge falls at the focal point of the lens 2, and becomes a bright/dark edge in angular space for the low-beam output. In other words, the angular output of the low-beam may have a sharp cutoff, with plenty of illumination below a particular threshold angle, and little or no illumination above the threshold angle. Such a sharp bright/dark edge is helpful in reducing glare for drivers in the oncoming direction.

The light baffle 4 may be formed in a variety of manners. In the configuration of FIG. 1, the light baffle 4 is made integral with portions of a stationary folding mirror 5 and, when present, portions of a light occluding member 100, each of which are described further below. In other configurations, one or both of these elements is made separately from the light baffle 4 and is attached to the light baffle 4. Regardless of how the light baffle 4, the stationary folding mirror 5 and the light occluding member 100 are attached to each other (integral vs. separate), the functions of these three elements remain unchanged. We discuss the functions of each of these elements in more detail, beginning with the light baffle 4.

At its most basic, the light baffle 4 is simply an edge that forms a distinct bright/dark shadow in a low-beam light distribution that strikes the edge. The light baffle 4 may include two generally planar surfaces that intersect in an angled edge, as is shown for the example in FIG. 1. Alternatively, the light baffle 4 may be a dedicated element that can be used to cast a shadow.

As drawn in FIG. 1, the light baffle 4 passes light above the edge and blocks light below the edge. After transmission through the lens 2, the headlight shows the edge as being with respect to an angle; light propagating downward (toward the ground) beyond the angular bright/dark edge is passed, while light propagating upward (toward the eyes of oncoming drivers) beyond the angular bright/dark edge is blocked.

In practice, the light baffle 4 is very close to the second focal point F2 of the concave reflector 3, but is displaced slightly from it. The displacement may be toward the first focus F1 and away from the lens 2, or may alternatively be away from the first focus F1 and toward the lens 2. Such a displacement helps ensure that the angular bright-dark edge does not exhibit significant color artifacts, such as appearing particularly blue or red before going dark. Such artifacts are caused by the property of dispersion in the lens, where the refractive index of the lens differs between the red and blue portions of the spectrum. The displacement discussed here is less than 1 mm, and typically is much less than 1 mm.

The light baffle 4 is shown as being generally horizontal, which is into the page in FIG. 1, and is perpendicular to the longitudinal axis Z. Note that when the headlight 1 is in an installed position, a generally horizontal orientation is generally parallel to the ground traversed by the vehicle. Such a horizontal orientation is good for blocking the light for oncoming traffic. In contrast, for illumination toward the shoulder, it is not necessary to enforce the same angular criteria, since there are no oncoming drivers on the shoulder and it may be necessary to read signs that are placed much higher than eye level. Such shoulder illumination may be accomplished easily by angling a portion of the light baffle 4. For instance, one half of the light baffle 4 may be as drawn, such as the half extending out of the page in FIG. 1, while the other half may be inclined azimuthally, such as the half extending into the page in FIG. 1. In other words, looking end-on from the front of the headlight 1, the left half of the baffle edge may extend horizontally, much like a clock hand extending to 9 o'clock, while the right half of the baffle edge may deviate from horizontal, much like a clock hand extending to 4 o'clock rather than 3 o'clock. In practice, the inclination may take on values up to 15 degrees or more, in order to achieve sufficient illumination of the shoulder. Note that the specific legal requirements for illumination vary from country to country, and each set of requirements will have its own suitable baffle edge shape. Note that in some cases, the light baffle 4 may have one or more notches or ridges at suitable locations.

Note that in some cases, the light baffle 4 may not lie fully in a single plane, but may bend or curl at its edges. Specifically, for the lateral edges of the baffle closest to the reader (out of the page) and farthest away from the reader (into the page) in FIG. 1, the baffle may bend toward the lens 2. Such a bending may improve the performance of the low-beam output. Note that such a bending may also be a consequence of deviating from a true ellipsoid for the concave reflector 3.

The stationary folding mirror 5, as drawn in FIG. 1, is made integral with the light baffle 4. As noted above, the mirror 5 may also be made separately and attached to the light baffle 4. Although the term "folding" may appear to connote some kind of motion, the term is well accepted in the art and merely implies that a beam's path becomes bent. The folding mirror 5 remains stationary in the position shown in FIG. 1, both for high-beams, when it reflects light from the high-beam LED array 8, and for low-beams, when it doesn't do much.

Regarding the folding mirror 5, the geometry shown in FIG. 1 is likely the simplest, where the high-beam LED array 8 emits light generally upward (in a distribution centered around a vertical axis), the mirror 5 is oriented at 45 degrees, and the light reflected off the mirror 5 emerges generally horizontally (in a distribution centered around the longitudinal axis) toward the lens 2. Alternatively, other geometries may be used that alter the mounting angle of the high-beam LED array 8 and the mirror 5 but keep the beam emergence generally horizontal. In other words, for any given mounting angle of the high-beam LED array 8, there is always an orientation of the folding mirror 5 to produce a generally horizontal emergent beam.

Note that the high-beam LED array 8 may be similar in structure and function to the low-beam LED array 7, or may optionally include more or fewer LED elements and may optionally have a different footprint.

The headlight 1 may optionally include a light occluding member 100. The light occluding member 100 (or member 16, discussed herein below), is positioned to prevent light from low-beam LED array 7 from going below the lower edge of the folding mirror 5.

As an example, the configuration of FIG. 1 shows the light occluding member 100 being generally horizontal, and lying approximately in a plane that contains the low-beam LED array 7 and intersects both foci F1, F2 of the concave reflector 3.

Note that for the configuration of FIG. 1, it is assumed that the low-beam LED array 7 and the high-beam LED array 8 are both oriented horizontally, so that when the headlight 1 is installed and in use, both LED arrays 7, 8 are horizontal and are generally parallel to the ground beneath the vehicle. In FIG. 1, the light occluding member 100 is generally parallel to the ground in the interior of the concave reflector 3, typically extending from the low-beam LED array 7 toward the light baffle 4.

It will be understood that as long as the light occluding member 100 blocks light from the low-beam LED array 7 from passing below the lower edge of the folding mirror 5, the light occluding member 100 may have any suitable orientation and shape. For instance, the light occluding member 100 may have some orientation other than horizontal, and/or may be inclined or bent as needed, provided that it still may block light from the low-beam LED array 7 from passing below the lower edge of the folding mirror 5.

In some configurations, the light occluding member 100 may be a reflective surface, and may be configured as a low-beam reflector 6. Any low-beam light that strikes the low-beam reflector 6 may be reflected back upwards toward the concave reflector 3. In addition, the low-beam reflector 6 prevents low-beam light from passing below the stationary folding mirror 5.

In other embodiments, the light occluding member 100 may be a corner or an edge of a heat sink 200 disposed between the low-beam LED array 7 and the stationary folding mirror 5, and/or behind the stationary folding mirror 5. The heat sink 200 can be formed by having the light occluding member 100 formed of metal or another thermally conductive mass and positioned in thermal communication with LED array 7 and/or LED array 8. Here, the light occluding member 100 may be an absorbing surface, may be a roughened surface that scatters incident light, or may be polished to be a reflecting surface.

In general, for any of the particular configurations, it is envisioned that the amount of light striking the light occluding member 100 will be relatively small, compared to the amount of light passing over the light occluding member and either striking the light baffle 4 or passing over the light baffle 4. If the light occluding member 100 is reflective, then the relatively small amount of light may be reclaimed as useful low-beam light.

Figure 2:
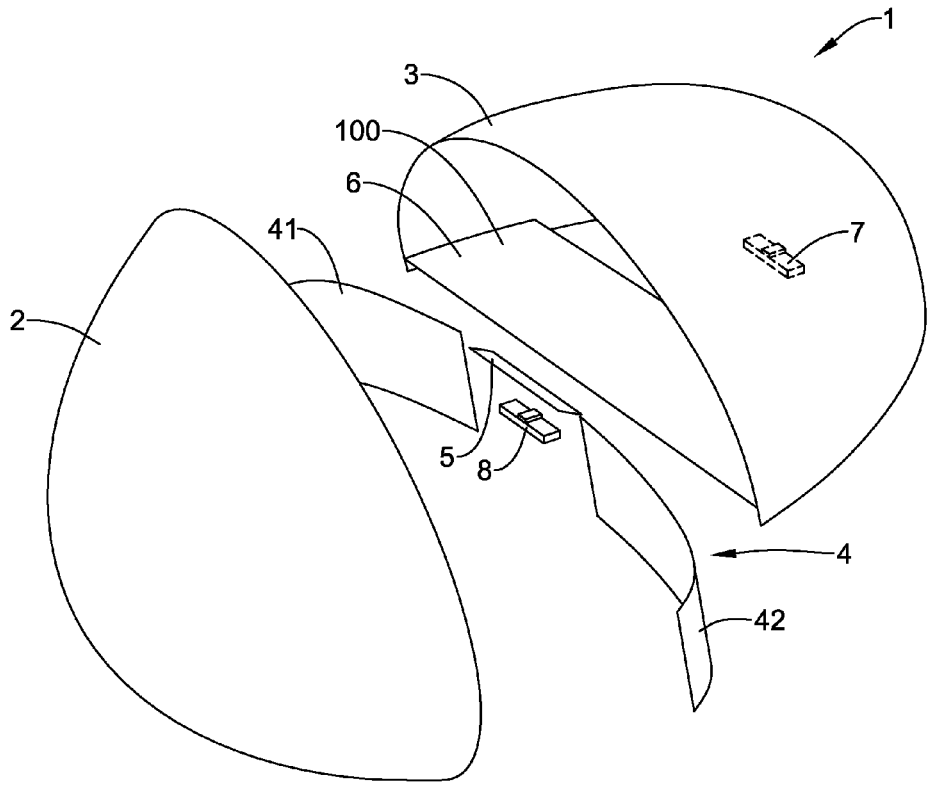
FIG. 2 is a perspective exploded-view drawing of the headlight of FIG. 1.

FIG. 2 is a perspective exploded-view drawing of the headlight 1 of FIG. 1.

It is instructive to consider the paths that light would take in FIG. 2, even though no rays are drawn in FIG. 2. In FIG. 2, low-beam light originates from the low-beam LED array 7, located near the top-right corner of FIG. 2 at a first focus of the concave reflector 3. The low-beam light projects generally upward and slightly to the left onto the concave reflector 3, which directs it to the second focus of the concave reflector 3, located near the folding mirror 5.

A bright/dark edge is formed in the low-beam light, arising from the light baffle 4, or it may arise from an edge of low-beam reflector 6, which can include a reflecting surface generally parallel with the ground or a portion of a heat sink 200. Alternatively, the bright/dark edge may be formed from an edge of the folding mirror 5, or from a structural element that holds the folding mirror 5 in place, or from a leading edge of a heat sink 200 supporting LED array 7. Alternatively, as will be discussed with reference to FIG. 7, the bright/dark edge may be formed by an edge 63 of a light occluding member 16. The low-beam light proceeds generally toward the bottom half of the aspheric lens 2, which directs it out of the headlight 1 in front of the vehicle.

In FIG. 2, high-beam light originates at the high-beam LED array 8 and projects generally upward and slightly to the left onto the folding mirror 5. The reflected high-beam light strikes both the top and bottom halves of the aspheric lens 2, which directs it out of the headlight 1 in front of the vehicle. This will be shown more clearly in FIG. 4.

FIG. 2 shows the light baffle 4 in more detail than FIG. 1. The light baffle 4 extends horizontally away from the folding mirror 5. In the configuration of FIG. 2, the lateral, horizontal edges 41, 42 of the light baffle 4 bend toward the lens 2. In other configurations, the light baffle 4 may be generally planar and may be generally vertical.

Figure 3:
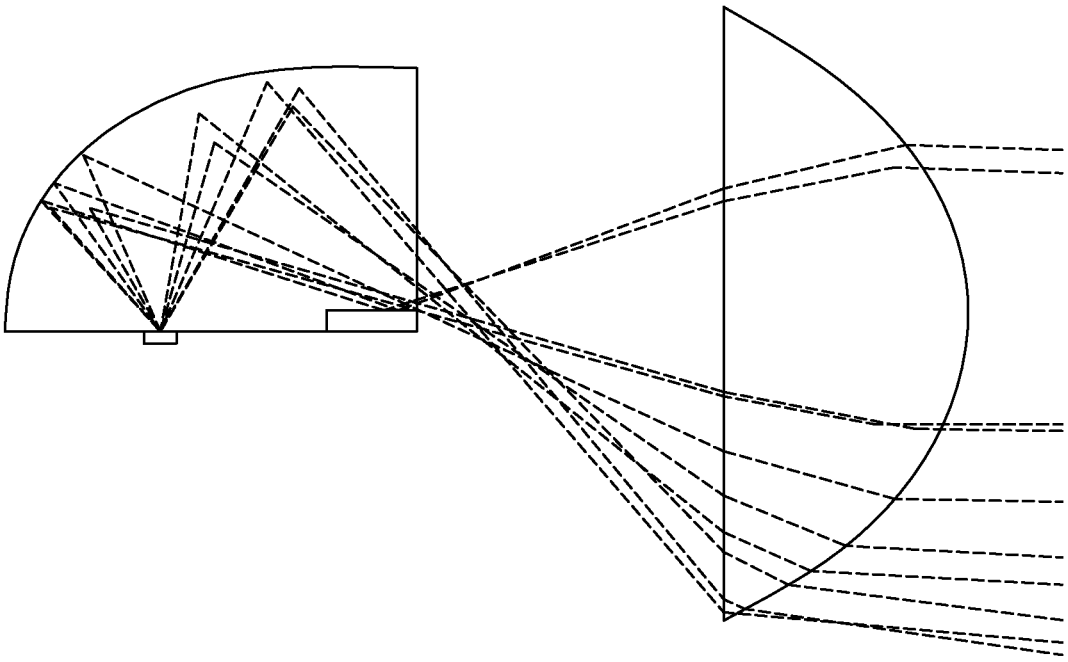
FIG. 3 is a side-view drawing of the headlight of FIGS. 1 and 2, including several representative low-beam light rays.

FIG. 3 is a side-view drawing of the headlight 1 of FIGS. 1 and 2, including several representative low-beam light rays traced from the low-beam LED array 7 out of the headlight 1. Most of the light passes over the folding mirror 5 to strike the lower half of the lens 2 and be bent downward, toward the ground. A smaller fraction of the light strikes the light occluding member 100; for the configuration in which the light occluding member 100 is reflecting as a low-beam reflector 6, the light is reflected back upwards toward the lens 2, which bends it generally downward, toward the ground.

Note that all or nearly all of the low-beam light shown in FIG. 3 leaves the headlight 1 propagating to the right with a slight downward inclination, with none or little light propagating with a slight upward inclination. In general, the emission pattern of the low-beam light exits the headlight 1 at lens 2, is deliberately left/right asymmetric, so that some low-beam light may propagate upwards on the shoulder and may illuminate signs higher than eye level, while low-beam light is kept out of the eyes of oncoming drivers on the opposite side of the road. For this reason, in the U.S. (and other regions that drive on the right side of the road), low-beam light leaving the headlight 1 and propagating slightly to the right of the driver may have more upward-traveling light than that propagating slightly to the left of the driver. This situation is reversed for regions that drive on the left side of the road.

Figure 5:
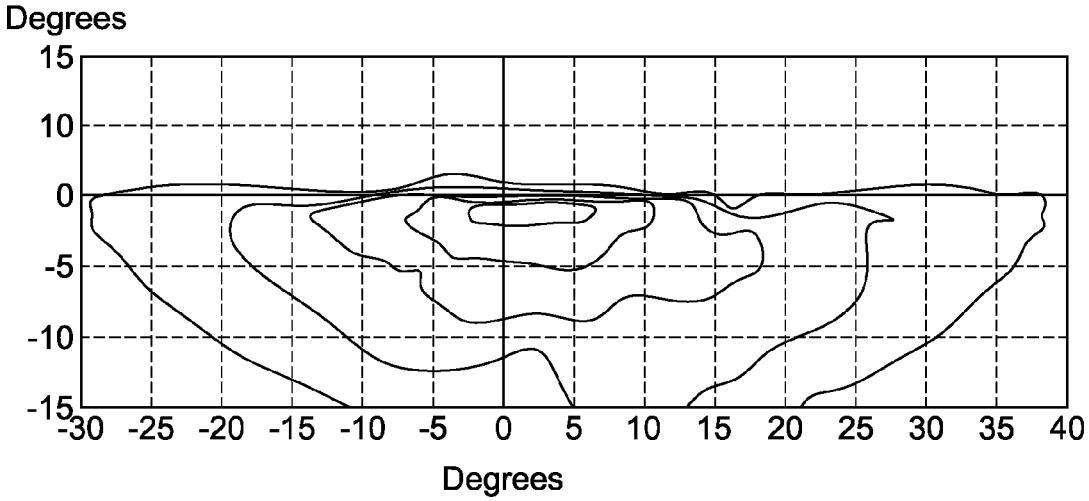
FIG. 5 is a contour plot of the low-beam output of the headlight of FIGS. 1 and 2.

As will be seen in FIG. 5, the left/right asymmetry of the emergent light is relatively small, typically on the order of one or two degrees. This asymmetry may be realized by tilting the mounting structure of the LED array 7, by altering the shape of the concave reflector 3 (typically done during the design/simulation phase), and/or by translating the lens 2 away from being perfectly centered. All of these ways to generate the asymmetry of the emergent light are well known to one of ordinary skill in the art. For the purposes of this document, despite the asymmetry of one or two degrees, we still refer to the longitudinal axis of the headlight 1 as being generally horizontal, and we still refer to the outputs of the LED arrays 7 and 8 as being generally vertical or having a distribution centered around a generally vertical axis.

Figure 4:
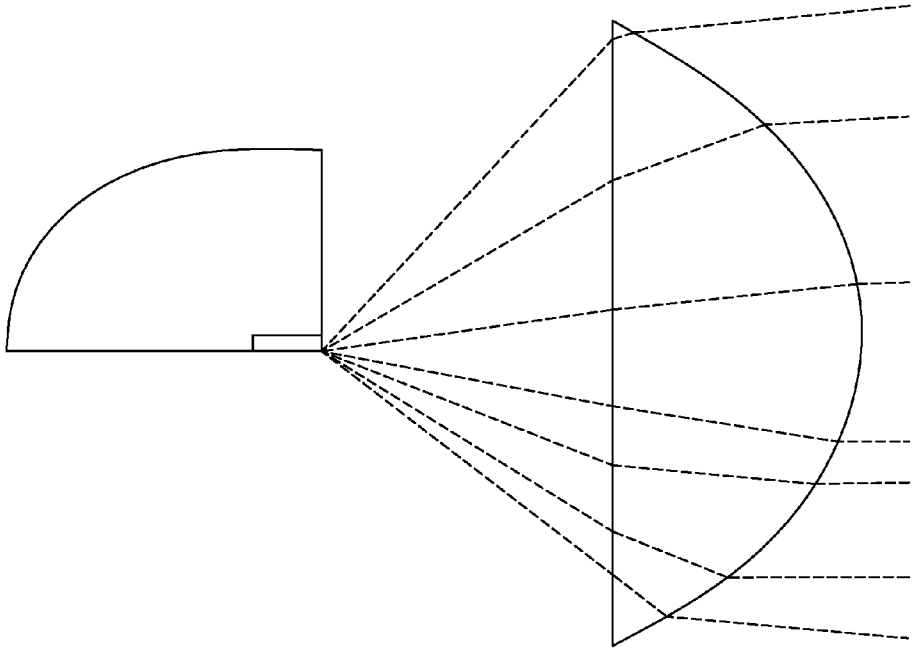
FIG. 4 is a side-view drawing of the headlight of FIGS. 1 and 2, including several representative high-beam light rays.

FIG. 4 is a side-view drawing of the headlight 1 of FIGS. 1 and 2, including several representative high-beam light rays traced from the high-beam LED array 8 out of the headlight 1. Note that the high-beam light leaves the headlight 1 with light having both slight upward and slight downward propagating angles.

Note that FIG. 3 shows only rays from the low-beam LED array 7, and that FIG. 4 shows only rays from the high-beam LED array 8. In FIGS. 3 and 4, the rays from each LED array are shown separately, for clarity. In practice, when the high beams are turned on, the low beams usually remain on, so that the real high-beam light output from the headlight 1 includes light from both the low-beam LED array 7 and the high-beam LED array 8. Note that in FIG. 6 below, a simulation of the high-beam output includes light contributions from both the low-beam LED array 7 and the high-beam LED array 8.

FIG. 5 is a contour plot of the low-beam output of the headlight 1. The horizontal and vertical scales are in degrees, with the (0, 0) point corresponding to directly in front of the vehicle. The shoulder is to the right in the plot, and oncoming traffic is to the left. There are three features on this plot of particular interest. First, nearly all the low-beam light emerges downward or nearly downward, so that there is little or no light above the zero-degree point on the vertical axis. Second, the "hot spot", or location of peak brightness, may be shifted by one or two degrees toward the shoulder and shifted by one or two degrees downward from true horizontal. (In some cases, the shift toward the shoulder may be greater than one or two degrees, may be less than one or two degrees, or may be zero.) Third, the "tails" of the low-beam light may extend farther toward the shoulder (to the right in FIG. 5) than toward oncoming traffic (to the left in FIG. 5). (In some cases, the tails may extend equally toward the shoulder and toward oncoming traffic.)

Note that adjustment of the low-beam output profile is done in a routine manner at the simulation stage of the headlight design. The output profile may be simulated by a variety of ray-tracing computer software, all of which can adjust the shapes and orientations of the low-beam LED array 7, the concave reflector 3, the light occluding member 100, the light baffle 4 and the lens 2. In general, all of these components except the lens 2 contribute only to the low-beam light output, and may be adjusted as needed without altering the high-beam output of the headlight 1.

There are several known ray-tracing programs that are commonly used to simulate the performance of the headlight and optimize the headlight design. For instance, the program Lucidshape is computer aided designing software for lighting design tasks, and is commercially available from the company Brandenburg GmbH, located in Paderborn, Germany. Other known computer software may also be used.

In general, a starting point for a typical design may use a rotationally symmetric ellipsoid as the concave reflector 3. The software may then adjust the surface profile of the concave reflector 3, and other components, to improve the performance, and coax the light output to resemble a desired set of specifications. The final concave reflector 3 may resemble an ellipsoid, but may deviate from a true ellipsoid, especially in the region closest to the lens 2. The final concave reflector 3 may also be rotationally asymmetric, which may improve performance without complicating the manufacturing process, since the components are typically produced by molding, rather than grinding and polishing.

Figure 6:
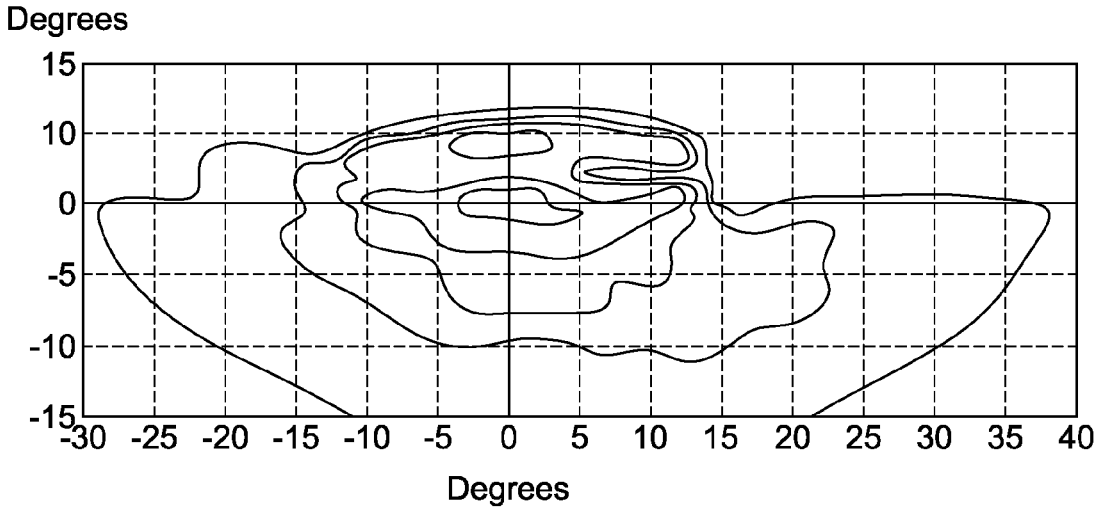
FIG. 6 is a contour plot of the high-beam output of the headlight of FIGS. 1 and 2.

Similarly, FIG. 6 is a contour plot of the high-beam output of the headlight 1. For this plot, the low-beam LED array 7 remains on when the high-beam LED array 8 is switched on, so that the intensities of the low- and high-beams add in the plot of FIG. 6. Although it is possible to switch off the low beams when the high beams are powered on, the low beams are typically left on when the high beams are powered on.

The high-beam output adds a significant amount of light above the horizon, which is typically left/right centered. It is assumed that the high beams are on only when there is no oncoming traffic, so there is little concern about impairing the vision of oncoming drivers for the high beams. Performance of the high-beam output may be improved or optimized in the same manner as for the low-beam output, using known ray-tracing software at the simulation phase of the design process.

For the designs shown in FIGS. 1-4, the bright/dark edge in the low beam light is formed by an explicit light baffle 4. In some alternate designs, it may be possible to remove the light baffle 4, to extend the front edge of the light occluding member 100 forward (toward the lens 2), and to use the extended front edge of the light occluding member 100 to form the bright/dark edge in the low beam light. Such a design may be simpler and less expensive to produce than the designs of FIGS. 1-4, since it includes the same functionality with one fewer piece part.

Figure 7:
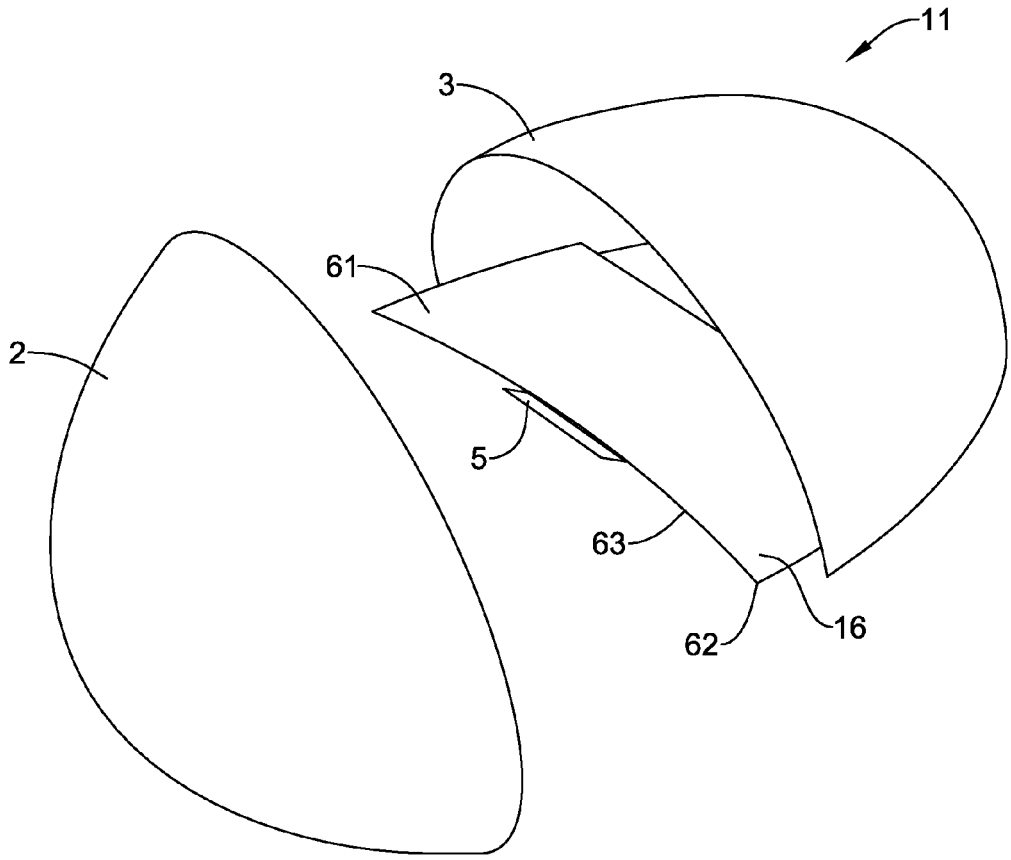
FIG. 7 is a perspective exploded-view drawing of another configuration of a headlight, viewed from slightly above.
Figure 8:
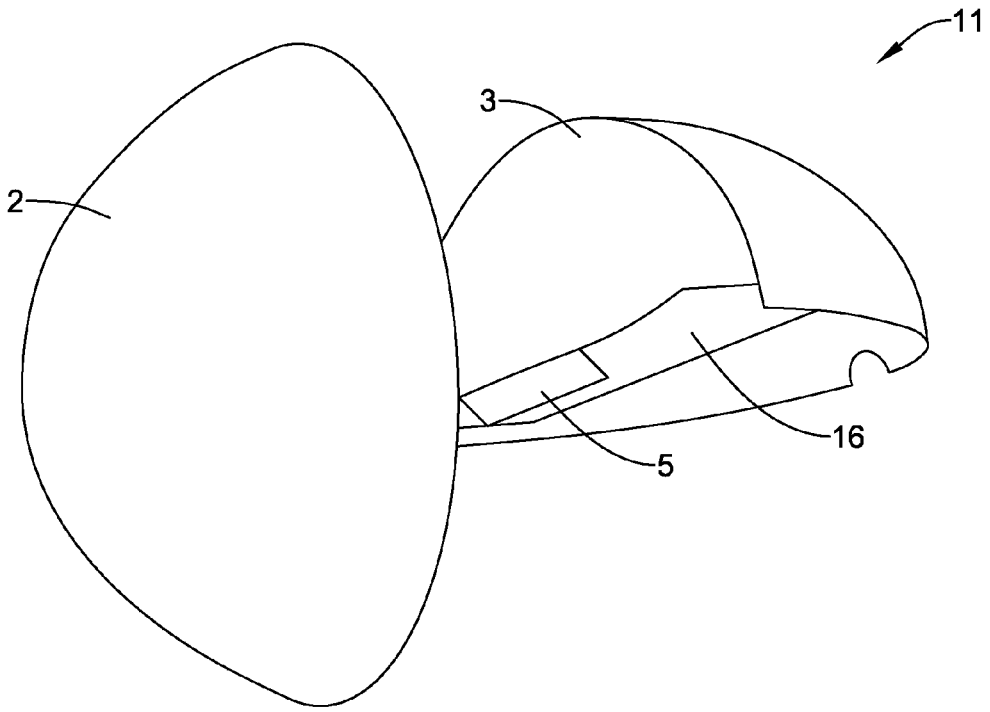
FIG. 8 is a perspective exploded-view drawing of the headlight of FIG. 7, viewed from slightly below.

FIGS. 7 and 8 are perspective exploded-view drawings of an example headlight 11 having such a forward-extending light occluding member 16, viewed from slightly above and slightly below, respectively. The front edge 63 of the light occluding member 16 forms the bright/dark edge in the low-beam light.

The low-beam and high-beam LED arrays are not shown in FIG. 7, but are in locations similar to those in FIG. 2, and direct light generally upward toward the concave reflector 3 and toward the folding mirror 5, respectively.

The light occluding member 16 extends further toward the lens 2 at its horizontal lateral edges 61, 62 than at its center, which is near the folding mirror 5. In some cases, the extension is left/right symmetric, as is shown in FIGS. 7 and 8. In other cases, the extension is left/right asymmetric. For example, one horizontal lateral edge 61 (or 62) may extend farther toward the lens 2 than the other horizontal lateral edge 62 (or 61). Alternatively, the shape of the front edge 63 of the light occluding member 16 may be left/right asymmetric, in order to help produce the asymmetric output distribution described above.

In some cases, the light occluding member 16 is planar. In some of those cases, the plane of the light occluding member 16 is horizontal, or parallel to the ground. In others of those cases, the plane of the light occluding member 16 is inclined with respect to the ground. For instance, the plane may be tilted forward, so that the front edge 63 of the light occluding member 16 is closer to the ground than the rear of the light occluding member 16. In some cases, the orientation of the plane may be left/right symmetric. In other cases, the plane may be tilted toward the left or the right of the headlight 11. In all of these cases, the light occluding member 16 is said to be "generally parallel" to the ground during use, even if the light occluding member 16 is inclined by one degree, two degrees, three degrees, four degrees, five degrees, ten degrees or more than ten degrees.

In some cases, the light occluding member 16 deviates from a plane. For instance, there may be some overall curvature to the light occluding member 16, or some localized curvature such as curling, ripples or waves at particular locations on the light occluding member 16.

In some cases, the light occluding member 16 extends laterally toward the concave reflector 3. In some cases, the light occluding member 16 and the concave reflector 3 define a volume that opens toward the lens 2, where the opening of the volume generally coincides with a top half of the lens 2. In some of these cases, the opening of the volume may be slightly smaller or slightly larger than the top half of the lens 2. In some cases, the light occluding member 16 is at or near the longitudinal axis of the headlight 11.

In some cases, the light occluding member 16 may extend laterally all the way out to the concave reflector 3. Such an extension may be complete around the relevant portion of the perimeter of the light occluding member 16, or may optionally include one or more breaks for clearance, ventilation, or other reasons. In other cases, the light occluding member 16 may extend out to, but not contact, the concave reflector 3.

Unless otherwise stated, use of the words "substantial" and "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

GLOSSARY: a non-limiting summary of above reference numerals

| | |
|---|---|
| 1 headlight | 2 lens |
| 3 concave reflector | 4 light baffle |
| 5 folding mirror | 6 low-beam reflector |
| 7 low-beam LED array | 8 high-beam LED array |
| 10 housing | 11 headlight |
| 16 light occluding member | 21 planar side of lens |
| 22 convex side of lens | 23 flange of lens |
| 24 groove in housing | 25 notch in housing |
| F1 first focus of concave reflector | F2 second focus of concave reflector |
| H high-beam output representative ray | L low-beam output representative ray |
| Z longitudinal axis | |
| 41 horizontal lateral edge of light baffle | |
| 42 horizontal lateral edge of light baffle | |
| 61 horizontal lateral edge of light occluding member | |
| 62 horizontal lateral edge of light occluding member | |
| 63 front edge of light occluding member | |
| 100 light occluding member | |

What is claimed is:

1. A headlight (1; 11) producing a low-beam and a high-beam and having a generally horizontal longitudinal axis (Z), comprising:

a transmissive lens (2) through which light exits the headlight;

a concave reflector (3) that receives low-beam light from a low-beam source (7) and directs reflected low-beam light toward the lens (2);

a cut-off edge (4; 5; 63) disposed longitudinally adjacent to the lens (2) that comprises an edge that blocks a portion of the reflected low-beam light and forms a bright/dark edge in the reflected low-beam light;

a stationary mirror (5) disposed proximate the edge of the cut-off edge (4; 5; 63), the mirror (5) receiving high-beam light directly from a high-beam source (8) and directing reflected high-beam light toward the lens (2), the reflected high-beam light lacking a bright/dark edge, and (5) wherein the cut-off edge (4; 5; 63) is defined by an upper edge of the stationary mirror (5).

2. A headlight (1; 11) producing a low-beam and a high-beam and having a generally horizontal longitudinal axis (Z), comprising:

a transmissive lens (2) through which light exits the headlight;

a concave reflector (3) that receives low-beam light from a low-beam source (7) and directs reflected low-beam light toward the lens (2);

a cut-off edge (4; 5; 63) disposed longitudinally adjacent to the lens (2) that comprises an edge that blocks a portion of the reflected low-beam light and forms a bright/dark edge in the reflected low-beam light;

a stationary mirror (5) disposed proximate the edge of the cut-off edge (4; 5; 63), the mirror (5) receiving high-beam light directly from a high-beam source (8) and directing reflected high-beam light toward the lens (2), the reflected high-beam light lacking a bright/dark edge, and wherein the cut-off edge (4; 5; 63) is defined by a top edge of a light baffle (4), the light baffle (4) being disposed generally perpendicular to the longitudinal axis (Z) and extending laterally horizontally from the stationary mirror (5).

3. The headlight (11) of claim 1, wherein the cut-off edge (4) is defined by a front edge (63) of a light occluding member (16); and wherein said light occluding member (16) is positioned to prevent light from the low-beam source (7) from going below a lower edge of the stationary mirror (5).

4. The headlight (1; 11) of claim 1, wherein the cut-off edge (4) is defined by a lateral edge of a heat sink (200) in thermal communication with at least one of a low-beam light source LED array (7) and a high-beam LED light source LED array (8).

5. The headlight (1; 11) of claim 1, wherein the cut-off edge (4) bends away from the concave reflector (3) and toward the lens (2) at its horizontal lateral edges (41, 42; 61, 62).

6. The headlight (1; 11) of claim 1, further comprising a light occluding member (100) disposed generally horizontally and proximate the longitudinal axis (Z);

wherein the concave reflector (3) extends upward above the light occluding member (100); and wherein low-beam light is reflected between the concave reflector (3) and the light occluding member (100) toward the lens (2).

7. The headlight (1; 11) of claim 6, wherein the light occluding member (100) and the concave reflector (3) define a volume that opens toward the lens (2); and wherein the opening of the volume generally coincides with a top half of the lens (2).

8. The headlight (1; 11) of claim 6, wherein the concave reflector (3) comprises a portion of a top half of an ellipsoid; and wherein the light occluding member (100) is planar and bisects said ellipsoid to define a boundary of said top half.

9. The headlight (1; 11) of claim 6, wherein the light occluding member (100) defines a secondary reflector (6) comprising a reflective surface.

10. The headlight (1; 11) of claim 6, wherein the light occluding member (100) comprises a corner of a heat sink (200).

11. The headlight (1; 11) of claim 1, wherein the concave reflector (3) has first and second foci (F1, F2) along the longitudinal axis (Z);

wherein the low-beam light originates proximate the first focus (F1); and wherein the stationary mirror (5) is disposed proximate the second focus (F2).

12. The headlight (1; 11) of claim 1, wherein the low-beam source (7) is a low-beam LED array;

wherein the high-beam source (8) is a high-beam LED array; and wherein the high-beam source (8) is disposed between the low-beam source (7) and the lens (2).

13. The headlight (1; 11) of claim 1, wherein the lens (2) has a generally planar side (21) facing the concave reflector (3) and has a convex side (22) facing away from the concave reflector (3).

14. The headlight (1; 11) of claim 1, wherein the lens (2) has a focal point disposed proximate the stationary mirror (5).

15. The headlight (1; 11) of claim 1, wherein said stationary mirror (5) is planar.

16. The headlight (1; 11) of claim 1, wherein a single said stationary mirror (5) reflects light from said high-beam source (8).

17. The headlight (1; 11) of claim 1, wherein said lens (2) comprises a single said lens.

18. A headlight (1) of claim 1, wherein said lens (2) has a single prescription.

19. A headlight (1) of claim 1, wherein said lens (2) has only one focus.

* * * * *